US010532572B2

(12) United States Patent
McMullen et al.

(10) Patent No.: US 10,532,572 B2
(45) Date of Patent: Jan. 14, 2020

(54) INKJET PRINTHEAD WITH STAGGERED FLUIDIC PORTS

(71) Applicant: Xaar Technology Limited, Cambridge (GB)

(72) Inventors: Robert Errol McMullen, Cambridge (GB); Peter Mardilovich, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 15/563,518

(22) PCT Filed: Mar. 18, 2016

(86) PCT No.: PCT/GB2016/050756
§ 371 (c)(1),
(2) Date: Sep. 29, 2017

(87) PCT Pub. No.: WO2016/156792
PCT Pub. Date: Oct. 6, 2016

(65) Prior Publication Data

US 2018/0086076 A1 Mar. 29, 2018

(30) Foreign Application Priority Data

Apr. 1, 2015 (GB) ..... 1505665.8

(51) Int. Cl.
*B41J 2/14* (2006.01)

(52) U.S. Cl.
CPC .. *B41J 2/14233* (2013.01); *B41J 2002/14419* (2013.01); *B41J 2002/14459* (2013.01); *B41J 2002/14491* (2013.01); *B41J 2202/12* (2013.01)

(58) Field of Classification Search
CPC ..... B41J 2/14233; B41J 2202/12; B41J 2002/14491; B41J 2002/14419; B41J 2002/14459
See application file for complete search history.

(56) References Cited

U.S. PATENT DOCUMENTS 6,024,436 A 2/2000 Katakura et al.
8,523,325 B2 9/2013 Sakurai et al.
(Continued)

FOREIGN PATENT DOCUMENTS

EP 2363291 A1 9/2011

OTHER PUBLICATIONS

Chinese First Office Action, in corresponding Chinese Application No. 201680019135.X, 6 pages, and machine translation (7 pages).
(Continued)

*Primary Examiner* — Henok D Legesse
(74) *Attorney, Agent, or Firm* — Finnegan, Henderson, Farabow, Garrett & Dunner, LLP

(57) ABSTRACT

An inkjet printhead having a fluidic chamber substrate, the fluidic chamber substrate having at least two droplet units provided in an array therein, the droplet units comprising: a fluidic chamber, a first fluidic port provided at a first surface of the fluidic chamber substrate, wherein the first fluidic port is in fluidic communication with the fluidic chamber, a nozzle formed in a nozzle layer provided at a second surface of the fluidic chamber substrate; and a vibration plate provided at the first surface of the fluidic chamber substrate, the vibration plate comprising an actuator for effecting pressure fluctuations within the fluidic chamber; and wherein the droplet units are arranged adjacent each other about an axis extending substantially in a width direction of the droplet units, wherein the first fluidic ports of the droplet units are staggered a first stagger offset distance from each
(Continued)

other substantially in a length direction of the droplet units, and wherein a wiring layer extends over the first surface of the fluidic chamber substrate and between the first fluidic ports.

20 Claims, 9 Drawing Sheets

(56) References Cited

U.S. PATENT DOCUMENTS

| | | | | |
|---|---|---|---|---|
| 8,678,558 | B2 | 3/2014 | Hotta | |
| 2005/0179732 | A1 | 8/2005 | Sato et al. | |
| 2006/0061632 | A1 | 3/2006 | Mita | |
| 2007/0024676 | A1* | 2/2007 | Kachi | B41J 2/14233 347/68 |
| 2007/0263036 | A1 | 11/2007 | Ito | |
| 2010/0214359 | A1 | 8/2010 | Von Essen et al. | |
| 2012/0281044 | A1 | 11/2012 | Andrews et al. | |
| 2015/0145927 | A1* | 5/2015 | Murochi | B41J 2/14209 347/68 |

OTHER PUBLICATIONS

UKIPO Examination Report; GB 1505665.8; dated Apr. 21, 2017.
UKIPO Examination Report; GB 1505665.8; dated Aug. 19, 2016.
PCT International Search Report and Written Opinion; PCT/GB2016/050756; dated Jun. 19, 2016.
UKIPO Examination Report; GB 1505665.8; dated Feb. 24, 2016.
UKIPO Search and Examination Report; GB 1505665.8; dated Oct. 2, 2015.

* cited by examiner

FIG. 3a(ii)

FIG. 3a(iii)

FIG. 3a(iv)

INKJET PRINTHEAD WITH STAGGERED FLUIDIC PORTS

BACKGROUND

The present invention relates to inkjet printheads, and particularly, but not exclusively, to inkjet printheads having staggered fluidic ports.

In inkjet printers, it is known to provide inkjet printheads having a plurality of droplet generating units arranged adjacent each other in arrays on a substrate, each droplet generating unit having a fluidic chamber, a nozzle and an actuator associated therewith, whereby the actuators are controlled to effect ejection of droplets of fluid from the nozzles onto a print medium. Using such functionality, characters and images may be printed on the print medium in a controlled manner.

It may be desirable to increase the number of nozzles within an inkjet printhead in order to increase the resolution of the inkjet printer.

However, increasing the number of nozzles in an inkjet printhead requires increasing the number of fluidic chambers, actuators and/or the size of the substrate material and, therefore, provides engineering, fabrication, design and cost challenges.

For example, when increasing the number of fluidic chambers within a fixed sized substrate, the distance between adjacent fluidic chambers is decreased. As such, there may be less space available between adjacent fluidic chambers for routing electrical traces which may be required, for example, to provide signals (e.g. drive signals) to the corresponding actuators.

Whilst the width of the electrical traces may be decreased to take account of the reduced available space, decreasing the width of the electrical traces increases the resistance of the electrical traces, and therefore, may require larger signals to control such actuators, which may be undesirable.

Furthermore, the increased resistance may result in increased electrical current being drawn through the portions of the electrical traces having decreased width.

Furthermore still, the increased electrical current may result in increased amounts of heat being generated within the portions of the electrical traces having decreased width (e.g. localised heating), thereby leading to a failure of the electrical traces as a consequence of, for example, burnout and/or electrical fusing.

It will be appreciated that failure of one or more electrical traces may negatively impact the operational performance of the inkjet printhead. For example, if an electrical trace used to supply a drive signal to an actuator fails, then that actuator may not function correctly or not at all.

Furthermore, inkjet printheads having electrical traces comprising micrometre (μm) width dimensions may be difficult to manufacture using presently available fabrication techniques (e.g. below 4 μm may be difficult to manufacture), and, therefore, may have a poor manufacturing yield in comparison to inkjet printheads having electrical traces with comparatively wider tracks. Furthermore, such electrical traces may be prone to cracking/failure, and, therefore, may affect the reliability of the inkjet printhead.

Whilst the thickness of the electrical traces may be increased to compensate for the reduced width, increasing the thickness thereof generally requires increasing the space between the adjacent fluidic ports, which, on a substrate of a fixed size, may result in reducing the number of associated nozzles on the substrate, which, in turn, will result in a reduced resolution.

Furthermore, increasing the thickness of the electrical traces means that depositing a protecting cover layer (e.g. a passivation material) on the electrical traces may be difficult to achieve due to an increased vertical height of the sidewalls of the electrical traces.

Therefore any such protecting cover layer may be unreliable, which may lead to cracking thereof. Such cracking may, in turn, result in fluid coming into contact with the electrical traces.

Fluid contacting the electrical traces is undesirable as it may result in failure thereof, as a consequence of, for example, an electrical short circuit between the fluid and the electrical trace(s).

The thickness of the protecting cover layer may be increased in order to sufficiently cover the side walls of electrical traces having increased thickness (e.g. to reduce the likelihood of the protecting later cracking). However, increasing the thickness of the electrical traces and/or the protecting cover layer adds to the topography of the surface of the substrate on which they are deposited. It will be appreciated that increasing the topography of the surface may increase the difficulty of depositing other features/elements thereon. For example, securely bonding a capping layer to the surface of the substrate may be more challenging.

SUMMARY

The invention seeks to address the aforementioned problems.

In a first aspect there is provided an inkjet printhead comprising: a fluidic chamber substrate, the fluidic chamber substrate having at least two droplet units provided in an array therein, the at least two droplet units comprising: a fluidic chamber, a first fluidic port provided at a first surface of the fluidic chamber substrate, wherein the first fluidic port is in fluidic communication with the fluidic chamber, a nozzle formed in a nozzle layer provided at a second surface of the fluidic chamber substrate and in fluidic communication with the fluidic chamber; a vibration plate provided at the first surface of the fluidic chamber substrate, the vibration plate comprising an actuator for effecting pressure fluctuations within the fluidic chamber; and wherein the droplet units are arranged adjacent each other about an axis extending substantially in a width direction of the droplet units, wherein the first fluidic ports of the droplet units are staggered a first stagger offset distance from each other substantially in a length direction of the droplet units, and wherein a wiring layer extends over the first surface of the fluidic chamber substrate and between the first fluidic ports.

Preferably, the wiring layer which extends between the first fluidic ports comprises an electrical trace.

Preferably, the wiring layer which extends between the first fluidic ports comprises one or more electrical traces, wherein at least one of the one or more electrical traces is configured to supply a signal to a corresponding actuator of the droplet units.

Preferably, a thickness of the one or more electrical traces is less than 2 micrometres (μm).

Preferably, the wiring layer which extends between the first fluidic ports comprises a protecting cover material, wherein the protecting cover material comprises a passivation material.

Preferably, the at least two droplet units further comprise a second fluidic port provided at the first surface of the fluidic chamber substrate and wherein the corresponding second fluidic ports are in fluidic communication with the corresponding fluidic chambers, wherein the corresponding second fluidic ports are staggered a second stagger offset distance from each other substantially in the length direction of the droplet units, wherein the wiring layer extends over the first surface of the fluidic chamber substrate and between the second fluidic ports.

Preferably, a separation gap is provided between a sidewall of the wiring layer and the first fluidic ports and/or a separation gap is provided between the wiring layer and the second fluidic ports.

Preferably, the first fluidic ports are fluidic inlet ports and/or wherein the second fluidic ports are fluidic outlet ports.

Preferably, the corresponding fluidic chambers, nozzles and/or actuators of the droplet units are staggered the first or second stagger offset distance substantially in the length direction of the droplet units.

Preferably, the stagger offset distance is greater than the length of a widest region (WR) of the first fluidic port.

Preferably, the first stagger offset distance is substantially equal to the second stagger offset distance.

Preferably, one or more of the first fluidic ports or the second fluidic ports are shaped to have reflection symmetry.

Preferably, the first fluidic ports are substantially: triangular shaped, square shaped, rectangular shaped, pentagonal shaped, hexagonal shaped, rhombus shaped, oval shaped or circular shaped.

Preferably, the second fluidic ports are substantially: triangular shaped, square shaped, rectangular shaped, pentagonal shaped, hexagonal shaped, rhombic, oval shaped or circular shaped.

Preferably, one or more of the first fluidic ports or second fluidic ports are shaped to have reflection asymmetry.

Preferably, the wiring layer is provided on the first surface of the fluidic chamber substrate.

Preferably, the wiring layer is provided on one or more layers provided on the first surface of the fluidic chamber substrate.

In a second aspect there is provided an inkjet printer comprising an inkjet printhead of any of claims 1 to 23 herein.

In a third aspect there is provided a fluidic chamber substrate, the fluidic chamber substrate having at least two droplet units provided in an array therein, the droplet units comprising: a fluidic chamber, a first fluidic port provided at a first surface of the fluidic chamber substrate, wherein the first fluidic port is in fluidic communication with the fluidic chamber, a nozzle formed in a nozzle layer provided at a second surface of the fluidic chamber substrate and in fluidic communication with the fluidic chamber; and a vibration plate provided at the first surface of the fluidic chamber substrate, the vibration plate comprising an actuator for effecting pressure fluctuations within the fluidic chamber; and wherein the droplet units are arranged adjacent each other about an axis extending substantially in a width direction of the droplet units, wherein the first fluidic ports of the droplet units are staggered a first stagger offset distance from each other substantially in a length direction of the droplet units, and wherein a wiring layer extends over the first surface of the fluidic chamber substrate and between the first fluidic ports.

BRIEF DESCRIPTION OF THE DRAWINGS

FIG. 3*a*(*ii*) is a schematic diagram showing a hexagonal shaped fluidic port according to a further embodiment;

FIG. 3*a*(*iii*) is a schematic diagram showing a further hexagonal shaped fluidic port according to a further embodiment;

FIG. 3*a*(*iv*) is a schematic diagram showing a circular shaped fluidic port according to a further embodiment;

DETAILED DESCRIPTION

Figure 1A:
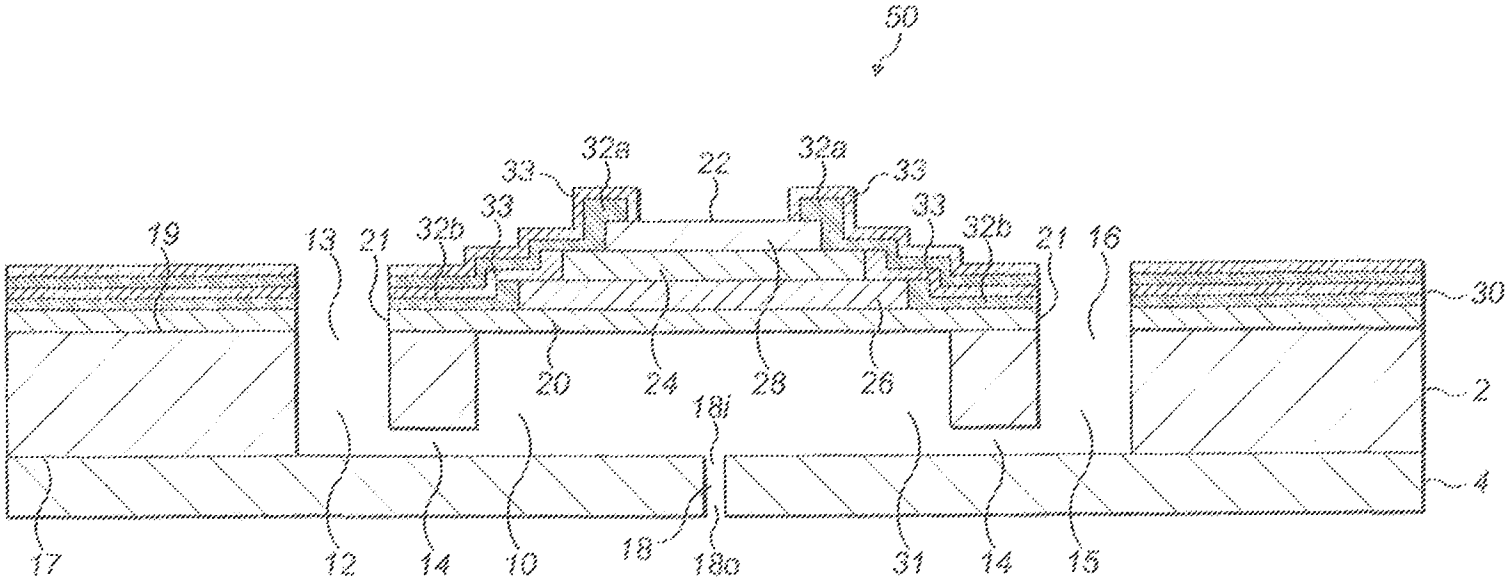
FIG. 1*a* is a schematic diagram showing a cross-section of an inkjet printhead having a droplet generating unit according to an embodiment.

FIG. 1*a* is a schematic diagram showing a cross-section of a roof-mode inkjet printhead 50 according to an embodiment. However, it will be appreciated that the invention is not limited to roof-mode inkjet printheads.

In following description, the inkjet printhead 50 is described as a thin film inkjet printhead, which may be fabricated using any suitable fabrication process(es), such as those used to fabricate structures for Micro-Electro-Mechanical Systems (MEMS).

However, as will be appreciated, the inkjet printhead 50 is not limited to being a thin film inkjet printhead, nor is the inkjet printhead 50 limited to being fabricated using such processing techniques as described above, and any suitable fabrication process(es) may be used. For example, the inkjet printhead 50 may be a bulk inkjet printhead.

The inkjet printhead 50, comprises a fluidic chamber substrate 2 and a nozzle layer 4.

The fluidic chamber substrate 2 comprises a droplet generating unit 6, hereinafter "droplet unit," whereby the droplet unit 6 comprises a fluidic chamber 10 and a fluidic inlet port 13 in fluidic communication therewith via a fluidic supply channel 12.

The fluidic inlet port 13 is provided in a top surface 19 of the fluidic chamber substrate 2 towards one end of the fluidic chamber 10 along a length thereof.

In the present embodiment, fluid, hereinafter "ink", is supplied to the fluidic chamber 10 from the fluidic inlet port 13. In the present embodiment the droplet unit 6 further comprises a fluidic channel 14 provided within the fluidic chamber substrate 2 in fluidic communication with the fluidic supply channel 12 and fluidic chamber 10, and arranged to provide a path for ink to flow therebetween.

Furthermore, the droplet unit 6 comprises a fluidic outlet port 16 in fluidic communication with the fluidic chamber 10, whereby ink may flow from the fluidic chamber 10 to the fluidic outlet port 16 via a fluidic channel 14 and fluidic return channel 15 formed in the fluidic chamber substrate 2.

In the present embodiment, the fluidic outlet port 16 is provided in the top surface 19 of the fluidic chamber substrate 2 towards an end of the fluidic chamber 10 opposite the end towards which the fluidic inlet port 13 is provided.

In alternative embodiments the fluidic inlet port 13 and/or fluidic outlet ports 16 may be provided within the fluidic chamber 10, whereby ink flows directly into the fluidic chamber 10 therethrough.

It will be appreciated that an inkjet printhead comprising droplet units 6 having fluidic inlet ports 13 and fluidic outlet ports 16, whereby fluid flows continuously from the fluidic inlet port 13 to the fluidic outlet port 16, along the length of the fluidic chamber 10 may be considered to operate in a recirculation mode, hereinafter "through-flow" mode.

In through-flow mode, the rate of flow of ink from the fluidic inlet port 13 to the fluidic chamber 10 is preferably chosen such that at any time during a print cycle (for example during ejection of fluid from the nozzle 18), the volume of ink supplied to the fluidic chamber 10 from the fluidic inlet port 13 is in excess of the volume of ink ejected from the nozzle 18.

It will be appreciated that in alternative embodiments, ink may be supplied to the fluidic chamber 10 from both fluidic ports 13 and 16 or the inkjet printhead may not be provided with a fluidic port 16 and/or ink return port 15 such that substantially all of the ink supplied to the fluidic chamber 10 is ejected from the nozzle 18. In such embodiments it will be appreciated that the device may be considered to operate in a non through-flow mode.

The fluidic chamber substrate 2 may comprise silicon (Si), and may for example be manufactured from a silicon wafer, whilst the features provided in the fluidic chamber substrate 2, including the fluidic chamber 10, fluidic supply channels 12/15, fluidic ports 13/16 and fluidic channels 14 may be formed using any suitable fabrication process, e.g. an etching process, such as deep reactive ion etching (DRIE) or chemical etching. In some embodiments, the features of the fluidic chamber substrate 2 may be formed from an additive process e.g. a chemical vapour deposition (CVD) technique (for example, plasma enhanced CVD (PECVD)), atomic layer deposition (ALD), or the features may be formed using a combination of etching and/or additive processes.

The nozzle layer 4 is provided at a bottom surface 17 of the fluidic chamber substrate 2, whereby "bottom" is taken to be a side of the fluidic chamber substrate 2 having the nozzle layer thereon.

In some embodiments the nozzle layer 4 may be attached (directly or indirectly) to the bottom surface 17 of the fluidic chamber substrate 2, for example by a bonding process (e.g. using adhesive).

It will be appreciated that there may be other materials/layers between the nozzle layer 4 and the bottom surface 17 of the fluidic chamber substrate 2 depending on the fabrication process and required features of the device (e.g. a passivation material, adhesion material).

In some embodiments, the surfaces of various features of the printhead may be coated with protective or functional materials, such as, for example, a suitable passivation or wetting material. Such surfaces may include, for example, an inner surface of the inlet port 13, an inner surface of the outlet port 16 and/or a surface of the fluidic chamber 10 and/or a surface of the nozzle 18.

The nozzle layer 4 may have a thickness of, for example between 10 μm and 200 μm, but it will be appreciated that any suitable thickness outside of the described range may be used as required.

The nozzle layer 4 may comprise any suitable material and may comprise the same material as the fluidic chamber substrate 2. The nozzle layer 4 may comprise, for example, a metal (e.g. electroplated Ni), a semiconductor (e.g. silicon) an alloy, (e.g. stainless steel), a glass (e.g. $SiO_2$), a resin material or a polymer material (e.g. polyimide, SU8).

In some embodiments, the nozzle layer 4 may be fabricated from the fluidic chamber substrate 2.

The droplet unit 6 further comprises a nozzle 18 in fluidic communication with the fluidic chamber 10, whereby the nozzle 18 is formed in the nozzle layer 4 using any suitable process e.g. chemical etching, DRIE, laser ablation. The nozzle comprises a nozzle inlet 18*i* and a nozzle outlet 180. The diameter of the nozzle outlet 18*o* may, for example, be between 5 μm and 100 μm, although the nozzle outlet 18*o* diameter may be outside that range, for example, as required for a particular application.

Furthermore, it will be appreciated by a person skilled in the art that the nozzle 18 may take any suitable form and shape as required, whereby, for example, the nozzle inlet 18*i* may have a diameter greater than the nozzle outlet 180.

In alternative embodiments, the diameter of the nozzle inlet 18*i* may be equal to or less than the diameter of the nozzle outlet 180.

The droplet unit 6 further comprises a vibration plate 20, provided on a top surface 19 of the fluidic chamber substrate 2, and arranged to cover the fluidic chamber 10. It will be appreciated that the top surface 19 of the fluidic chamber substrate 2 is taken to be the surface of the fluidic chamber substrate 2 opposite the bottom surface 17.

The vibration plate 20 is deformable to generate pressure fluctuations in the fluidic chamber 10, so as to change the volume within the fluidic chamber 10, such that ink may be discharged from the fluidic chamber 10 via the nozzle 18 e.g. as a droplet, and/or for drawing ink into the fluidic chamber e.g. via the fluidic inlet port 13 and the fluidic outlet port 16.

The vibration plate 20 may comprise any suitable material, such as, for example a metal, an alloy, a dielectric material and/or a semiconductor material. Examples of suitable materials include silicon nitride ($Si_3N_4$), silicon dioxide ($SiO_2$), aluminium oxide ($Al_2O_3$), titanium dioxide ($TiO_2$), silicon (Si) or silicon carbide (SiC). It will be appreciated that the vibration plate 20 may additionally or alternatively comprise multiple layers of material.

The vibration plate 20 may be formed using any suitable technique, such as, for example, ALD, sputtering, electrochemical processes and/or a CVD technique. It will be appreciated that apertures 21 corresponding to the fluidic ports 13/16 may be provided in the vibration plate 20, e.g. using a patterning/masking technique during the formation of the vibration plate 20.

It will be appreciated that the apertures 21 may be the same shape as the fluidic ports 13/16 or may be a different shape.

In some embodiments, the vibration plate may be formed from the fluidic chamber substrate 2.

The thickness of the vibration plate 20 may be any suitable thickness as required by an application, e.g. between 0.3 μm and 10 μm. However it will be appreciated by a person skilled in the art that a vibration plate which is too rigid may require relatively large signals to be supplied to an actuator provided thereon in order to obtain a specific amount of deformation in comparison to more compliant vibration plates, whilst a vibration plate which is too compliant may impact on the reliability and/or specific performance parameters of the device in comparison to more rigid vibration plates.

The droplet unit 6 further comprises an actuator 22, as a source of electro-mechanical energy, which is provided on the vibration plate 20, and arranged to deform the vibration plate 20.

In the following embodiments, the actuator 22 is depicted as a piezoelectric actuator 22 comprising a piezoelectric element 24 located between two electrodes. However, it will be appreciated that any suitable type of actuator or electrode configuration capable of deforming the vibration plate 20 may be used.

The piezoelectric element 24 may, for example, comprise lead zirconate titanate (PZT), but any suitable material may be used.

A lower electrode 26 is provided on the vibration plate 20. The piezoelectric element 24 is provided on the lower electrode 26 using any suitable fabrication technique. For example, a sol-gel deposition technique and/or ALD may be used to deposit successive layers of piezoelectric material on the lower electrode 26 to form the piezoelectric element 24.

An upper electrode 28 is provided on the piezoelectric element 24 at the opposite side of the piezoelectric element 24 to the lower electrode 26. The lower electrode 26 and upper electrode may comprise any suitable material e.g. iridium (Ir), ruthenium (Ru), platinum (Pt), nickel (Ni) iridium oxide ($Ir_2O_3$), $Ir_2O_3$/Ir, aluminium (Al) and/or gold (Au). The lower electrode 26 and upper electrode 28 may be formed using any suitable techniques, such as, for example, a sputtering technique.

It will be appreciated that further material/layers (not shown) may also be provided in addition to the upper/lower electrodes 26/28 and piezoelectric elements 24 as required. For example, a titanium (Ti) adhesion material may be provided between the upper electrode 28 and piezoelectric element 24, to improve adhesion therebetween. Furthermore, an adhesion layer may be provided between the lower electrode 26 and the vibration plate 20.

A wiring layer 30 is provided on the vibration plate 20, whereby the wiring layer 30 may comprise two or more electrical traces 32*a*/32*b* for example, to connect the upper electrode 28 and/or lower electrode 26 of the piezoelectric actuator 22 to drive circuitry (not shown). The electrical traces 32*a*/32*b* may have a thickness of between 0.01 μm and 2 μm, and preferably between 0.1 μm and 1 μm, and preferably still between 0.3 μm and 0.7 μm.

The electrical traces 32*a*/32*b* preferably comprise conductive material of suitable conductivity, e.g. copper (Cu), gold (Ag), platinum (Pt), iridium (Ir), aluminium (Al), titanium nitride (TiN).

It will be appreciated that the electrical traces 32*a*/32*b* may supply signals to the electrodes 26/28 from the drive circuit (not shown).

The wiring layer 30 may comprise further materials (not shown), for example, a passivation material 33 to protect the electrical traces 32*a*/32*b* e.g. from the environment to reduce oxidation of the electrical trace and/or during operation of the printhead to prevent the electrical traces 32*a*/32*b* from contacting the ink etc.

Additionally or alternatively, the passivation material 33 may comprise a dielectric material provided to electrically insulate electrical traces 32*a*/32*b* from each other e.g. when stacked atop one another or provided adjacent each other.

The passivation material may comprise any suitable material, for example: $SiO_2$, $Al_2O_3$.

As will be appreciated by a person skilled in the art, the wiring layer 30 may also comprise electrical connections, e.g. electrical vias (not shown), for example to electrically connect the electrical traces 32*a*/32*b* in the wiring layer 30 with the electrodes 26/28 through the passivation material 33.

The wiring layer 30 may further comprise adhesion materials (not shown) to provide improved bonding between, for example, the electrical traces 32*a*/32*b*, the passivation material 33, the electrodes and/or to the vibration plate 20.

The materials within the wiring layer 30 (e.g. the electrical traces/passivation material/adhesion material etc.) may be provided using any suitable fabrication technique such as, for example, a deposition/machining technique e.g. sputtering, CVD, PECVD, ALD, laser ablation etc. Furthermore, any suitable patterning technique may be used as required (e.g. providing a mask during sputtering and/or etching).

As will be appreciated by a person skilled in the art, when a voltage is applied between the upper electrode 28 and lower electrode 26, a stress is generated in the piezoelectric element 24, causing the piezoelectric actuator 22 to deform on the vibration plate 20. Pressure is varied in the fluidic chamber 10 by the corresponding displacement of the vibration plate 20. Using such functionality ink droplets may be discharged from the nozzle 18 by driving the piezoelectric actuator 22 with an appropriate signal. The signal may be supplied from a drive circuit (not shown), for example, as a voltage waveform.

As described below, the inkjet printhead 50 may comprise a plurality of droplet units 6. Therefore, the fluidic chamber substrate 2 comprises partition walls 31 provided between each of the droplet units 6 along the length direction thereof.

As will be appreciated by a person skilled in the art, the inkjet printhead 50 may comprise further features not described herein. For example, a capping substrate (not shown) may be provided atop the fluidic chamber substrate 2, provided, for example, on the top surface 19, the vibration plate 20 and/or the wiring layer 30, to cover the piezoelectric actuator 22 and to protect the piezoelectric actuator 22 during operation of the inkjet printhead 50. The capping substrate may further define fluidic channels for supplying ink to the fluidic inlet ports 13 e.g. from an ink reservoir and for receiving ink from the fluidic outlet port 16. For example, the capping layer may function as an ink manifold.

Furthermore, additional layers/materials not described herein may be provided on the top surface 19 of the fluidic chamber substrate 2. For example, such additional layers/materials may be provided between the actuator 22 and the vibration plate 20, between the wiring layer 30 and the vibration plate 20 and/or between the vibration plate 20 and the top surface 19. Apertures may be provided in the additional layers/materials corresponding to the fluidic ports 13/16 and/or apertures of the vibration plate 20.

Figure 1C:
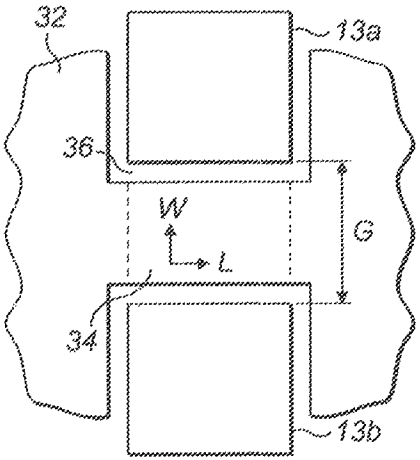
FIG. 1*c* is a schematic diagram showing a top down view of an electrical trace provided between two adjacent fluidic ports of the droplet generating units of FIG. 1*b;*
Figure 1B:
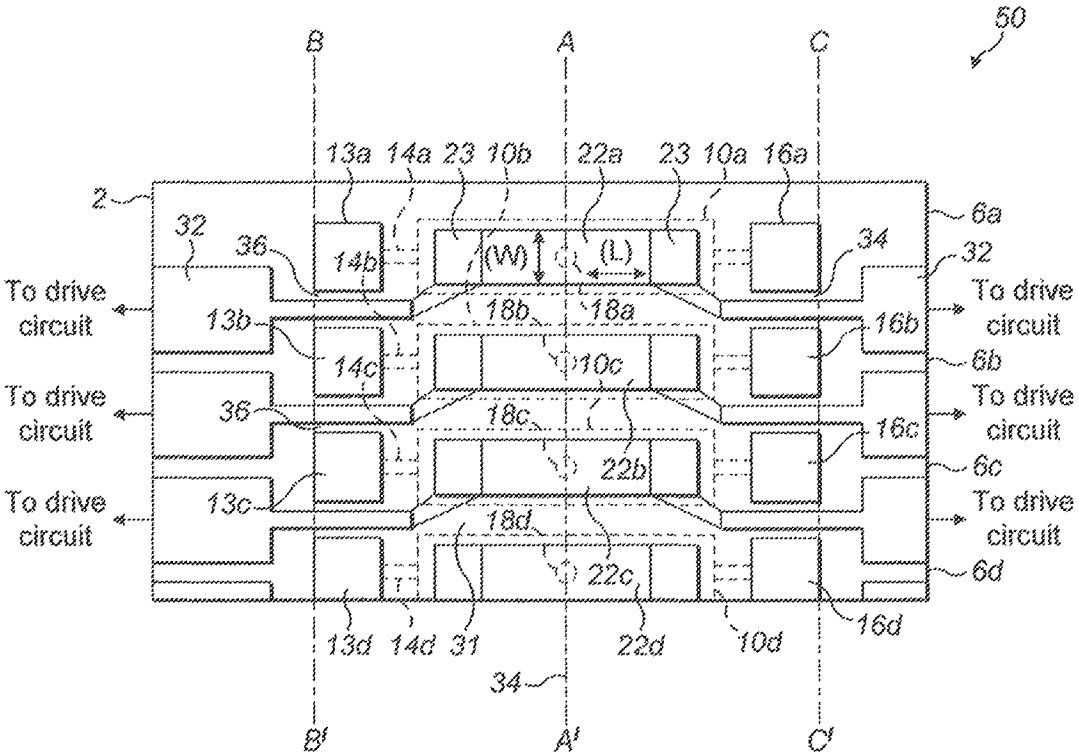
FIG. 1*b* is a schematic diagram showing a top down view of the inkjet printhead of FIG. 1*a* having an array of the droplet generating units arranged in a non-staggered configuration.

FIG. 1*b* is a schematic diagram showing a top down view of the inkjet printhead 50 having an array of droplet units 6*a*-6*d* arranged in a non-staggered configuration in the fluidic chamber substrate 2, whereby the droplet units 6*a*-6*d* may be formed within a single fluidic chamber substrate 2 separated by partition walls 31, whilst FIG. 1*c* is a schematic diagram showing fluidic ports 13*a*/13*b* of corresponding droplet units 6*a* and 6*b* in greater detail.

Whilst only four droplet units 6*a*-6*d* are schematically shown in FIG. 1*b*, it will be appreciated that the inkjet printhead 50 may comprise any suitable number of droplet units, e.g. the inkjet printhead 50 may comprise three hundred droplet units arranged to provide 300 nozzles per inch (NPI).

In alternative embodiments the number of droplet units 6 may be increased, for example to provide up to 600 or 1200 NPI. It will be appreciated that the specific number of droplet units provided may be dependent on application requirements and engineering constraints e.g. the size of the fluidic chamber substrates.

In FIG. 1*b*, a plurality of droplet units 6*a*-6*d* are arranged in a row along an axis (A-A') extending in a width direction (W) of the droplet units, whereby adjacent droplet units are arranged in a non-staggered configuration with respect to each other.

As adjacent droplet units 6*a*-6*d* are arranged in a non-staggered configuration with respect to each other, the respective fluidic chambers 10*a*-10*d*, nozzles 18*a*-18*d*, fluidic channels 14*a*-14*d* (all depicted by dashed outlines in FIG. 1*b*), piezoelectric actuators 22*a*-22*d* and fluidic ports 13*a*-13*d*/16*a*-16*d* are also arranged in a non-staggered configuration with respect to each other (as indicated by B-B' and C-C').

It will be appreciated that the electrical traces 32 of the wiring layer 30 extend from the piezoelectric actuators 22*a*-22*d*, between adjacent fluidic ports 13*a*-*d*/16*a*-*d*, to a drive circuit (not shown).

In the illustrative example of FIGS. 1*b* and 1*c*, the widths of the electrical traces 32 between the fluidic ports 13*a*-*d*/16*a*-*d* are limited by the distance between the closest points of the adjacent fluidic ports 13*a*-*d*/16*a*-*d* (depicted as (G) in FIG. 1*c*). Therefore, it will be seen that the electrical traces 32 comprise a reduced portion 34 between adjacent fluidic ports 13*a*-*d*/16*a*-*d*.

Furthermore, depending on the application, a separation gap 36 may be provided between the fluidic ports 13*a*-*d*/16*a*-*d* and the electrical traces 32 e.g. to reduce the likelihood of ink contacting the electrical traces 32 as the ink enters/exits the fluidic ports 13*a*-*d*/16*a*-*d* during operation of the inkjet printhead 50. The separation gap 36 may reduce the likelihood of a short circuit between ink entering/exiting the fluidic ports 13*a*-*d*/16*a*-*d* and the electrical trace, thereby increasing the reliability of the inkjet printhead.

In order to increase the separation gap 36 between the fluidic ports and electrical traces, the width of the electrical traces 32 may be further reduced at the reduced portion 34, thereby resulting in an increased resistance of the electrical traces 32, which, as described above, may require larger signals and may result in localised heat generation within the narrow portion, e.g. due to increased electrical current being drawn therethrough, leading to an increased risk of the electrical traces 32 failing.

Alternatively, the cross sectional area of the fluidic ports may be reduced, which in turn may affect the flow of ink into the fluidic chambers in communication therewith due to increased flow resistance and inertance, which, in turn may negatively affect print performance.

In the present embodiments, the electrical traces 32 are deposited as thin film materials having thicknesses in the micrometre scale, and therefore, it will be appreciated that the resistance (R) of a portion (e.g. the reduced portion) of an electrical trace is inversely proportional to the width of the portion, and is given by:

$$R = R_s \frac{L}{W}$$

whereby:

R is resistance of a portion of the electrical trace;

L is the length of the portion;

W is width of the portion; and $R_s$ is sheet resistance ((Ohms (Ω)/Square (Sq)) and is given by:

$$R_s = \frac{\rho}{t}$$

whereby:

ρ is resistivity of the portion; and t is thickness of the portion.

Whilst the resistance (R) of the electrical traces 32 of the present embodiments may vary inversely proportionally to variations in the thickness (t) thereof, it will be appreciated that, for thin films, it may not be possible to increase the thickness as required to achieve a suitable resistance value.

As such, decreasing the width of the electrical traces 32 at the reduced portions 34 will result in an increased resistance of the reduced portion 34 unless the material properties (e.g. conductivity properties) thereof are suitably altered to compensate for the decreased width.

Typically however, such compensation will require added processing complexity, design constraints, manufacturing capability and/or incur higher cost.

As described above, electrical traces having higher resistances may require larger signals (e.g. Voltage, Power) to be supplied to the piezoelectric actuators 22*a-d* via the electrical traces in comparison to electrical traces having relatively low resistance, which may be inefficient and undesirable for an inkjet printhead, and may lead to failure of the electrical traces 32 (e.g. due to burnout), and, therefore, result in reduced operational performance of the inkjet printhead.

In some examples, the thickness of the electrical traces 32 may be increased to reduce the resistance thereof. However, as above, a passivation material 33 may be required to be provided thereon, whereby increasing the thickness of an electrical trace may result in vertical sidewalls thereon, which may be difficult to cover with the passivation material 33.

Furthermore, the distance (G) between adjacent fluidic ports 13*a-d*/16*a-d* may be increased, such that the width of the reduced portions 34 therebetween may be increased. However, such a configuration may decrease the number of droplet units which may be provided within the fluidic chamber substrate 2, thereby reducing the number of nozzles within the inkjet printhead 50. As such the resolution of the inkjet printhead 50 may be reduced, which may result in a reduction in achievable print quality.

Whilst the size of the fluidic chamber substrate 2 may be increased to accommodate increased widths between adjacent droplet units, increasing the size of the fluidic chamber substrate 2 may result in increased material and processing costs, and hinder ease of integration into existing printers.

Figure 2A:
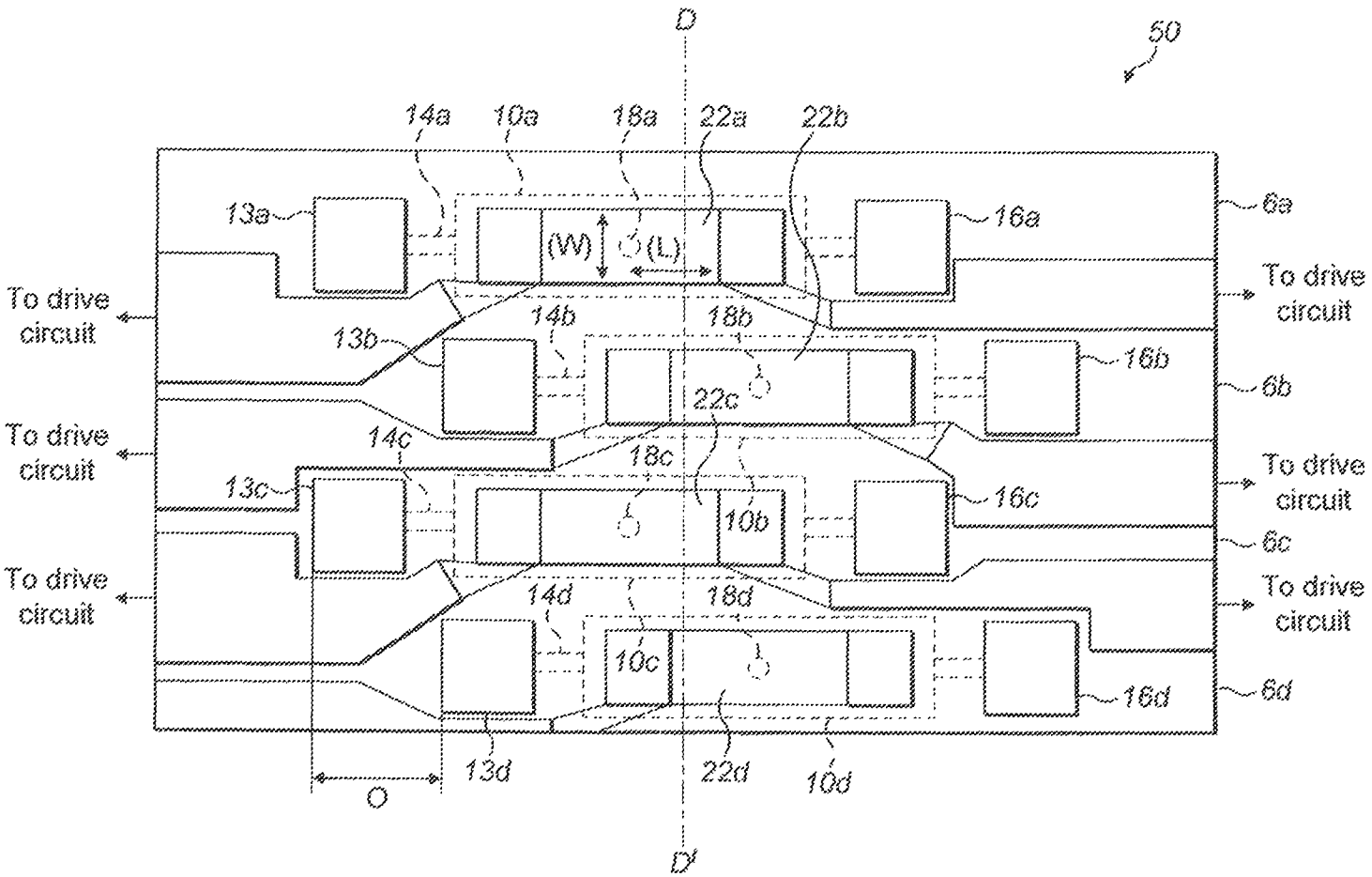
FIG. 2*a* is a schematic diagram showing a top down view of the inkjet printhead of FIG. 1*a* having an array of droplet generating units arranged in a staggered configuration according to an embodiment.
Figure 2C:
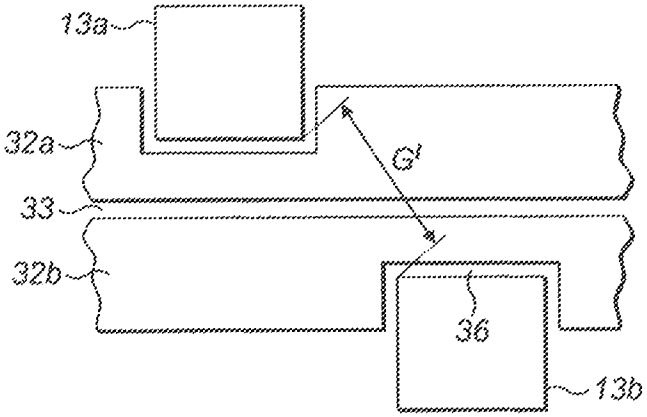
FIG. 2*c* is a schematic diagram showing a top down view of a plurality of electrical traces provided between adjacent fluidic ports of the droplet generating units of FIG. 2*a* according to a further embodiment.
Figure 2B:
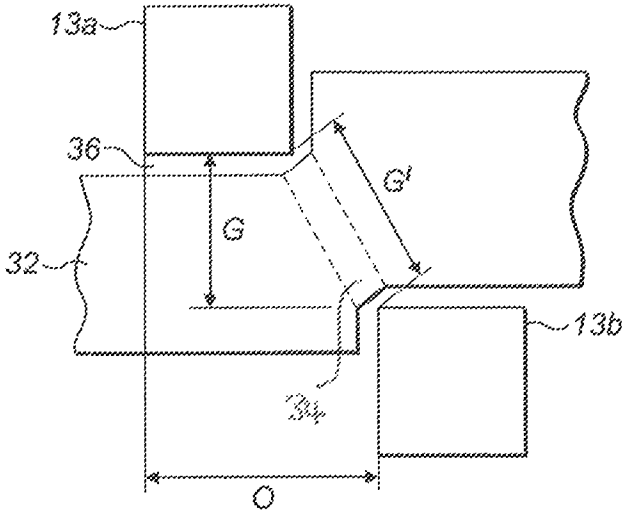
FIG. 2*b* is a schematic diagram showing a top down view of an electrical trace provided between adjacent fluidic ports of the droplet generating units of FIG. 2*a* according to an embodiment.

FIG. 2*a* is a schematic diagram showing a top down view of the inkjet printhead 50 having an array of droplet units 6*a*-6*d* arranged in a staggered configuration according to an embodiment; FIG. 2*b* is a schematic diagram showing a top down view of an electrical trace 32 provided between adjacent fluidic ports 13*a*/13*b* of the droplet units 6*a*-6*d*; whilst FIG. 2*c* is a schematic diagram showing a top down view of a plurality of electrical traces 32*a*/32*b* provided between adjacent fluidic ports 13*a*/13*b* of the droplet units 6*a*-6*d*. The numbering used to describe features above will be used to describe like features below.

As above, the inkjet printhead 50 comprises an array of droplet units 6*a*-6*d* as previously described.

In FIG. 2*a*, adjacent droplet units 6*a*-6*d* are arranged in a row in the fluidic chamber substrate 2, about an axis (D-D') extending substantially in a width direction (W) of the droplet units 6*a*-6*d*, whereby adjacent droplet units 6*a*-6*d* are arranged in a staggered configuration, offset from each other by a stagger offset distance (O), in a direction substantially perpendicular to the width direction of the droplet units 6*a*-6*d* (i.e. in a length direction (L) thereof).

Therefore, as depicted in FIG. 2*a*, the corresponding fluidic chambers 10*a*-10*d*, nozzles 18*a*-18*d*, fluidic channels 14*a*-14*d* (all depicted by dashed outlines in FIG. 2*a*), piezoelectric actuators 22*a*-22*d* and fluidic ports 13*a*-13*d*/16*a*-16*d* are also staggered with respect to each other by the stagger offset distance (O).

In some embodiments only certain features of adjacent droplet units 6*a*-6*d* may be staggered with respect to each other.

For example, the corresponding fluidic inlet ports 13*a*-13*d* and/or fluidic outlet ports 16*a*-16*d* of adjacent droplet units 6*a*-6*d* may be staggered with respect to each other, whilst other features, such as fluidic chambers 10*a*-10*d*, nozzles 18*a*-18*d*, fluidic channels 14*a*-14*d* and/or piezoelectric actuators 22*a*-22*d* may be non-staggered with respect to each other.

Furthermore, in some embodiments, features of adjacent droplet units may be staggered by a different stagger offset distance (O) relative to other features of the corresponding droplet units. For example, fluidic inlet ports 13*a*-13*d* of adjacent droplet units may be staggered by a stagger offset distance e.g. ((O) μm+/−x μm), whilst other features such as fluidic chambers 10*a*-10*d*, nozzles 18*a*-18*d*, fluidic channels 14*a*-14*d*, piezoelectric actuators 22*a*-22*d* and/or fluidic outlet ports 16*a-d* may be staggered by a second stagger offset distance ((O) μm+/−y μm).

Staggering adjacent fluidic ports 13*a*-13*d*/16*a*-16*d* with respect to each other increases the distance between the closest points between the staggered adjacent ports 13*a*-13*d*/16*a*-16*d* in comparison to a non-staggered configuration.

Such functionality is demonstrated in FIG. 2*b*, whereby the fluidic ports 13*a*/13*b* are offset from each other by the stagger offset distance (O). As shown in FIG. 2*b*, the distance (G') between closest points of adjacent fluidic ports 13*a*/13*b* of the staggered configuration is greater than the distance (G) between the closest point of adjacent fluidic ports and of the non-staggered configuration schematically shown in FIGS. 1*b* and 1*c*.

As such, it will be appreciated that the width of the reduced portion 34 of an electrical trace 32 passing between adjacent fluidic ports 13*a*/13*b* arranged in a staggered configuration may be increased in comparison to the width of a reduced portion of an electrical trace 32 passing between adjacent fluidic ports arranged in a non-staggered configuration.

It will also be appreciated that to "pass between" adjacent fluidic ports is taken to include configurations whereby the wiring layer is provided on a different plane as the fluidic ports 13*a-d*/16*a-d*. For example, as above, the wiring layer may be provided atop the vibration plate, whilst the fluidic ports 13*a*-13*d*/16*a*-16*d* may be provided on the top surface of the fluidic chamber substrate 2.

Furthermore, the length of the reduced portion 34 of an electrical trace 32 may be shorter in a staggered configuration in comparison to a non-staggered configuration.

Therefore, the corresponding resistance of the electrical traces 32 may be decreased both at the reduced portions 34 thereof, and, as a result, along the length of the electrical trace 32.

Additionally or alternatively, a larger separation gap 36 (e.g. 6-15 μm) may be provided between the fluidic ports 13*a*-13*d* and electrical traces 32 when using a staggered configuration whilst maintaining a similar or lower resistance for the reduced portion 34 of the electrical traces 32 in comparison to the non-staggered configuration.

Therefore, it will be appreciated that, in comparison to fluidic ports arranged in a non-staggered configuration, a staggered configuration allows for the resistance of the electrical trace 32 to be decreased along the length thereof by increasing the width of the electrical trace 32 at the reduced portion 34 and/or by shortening the length of the reduced portion 34.

Furthermore, as the width of electrical traces 32 may be increased between adjacent fluidic ports in a staggered configuration in comparison to a non-staggered configuration, the thickness of electrical traces 32 may be decreased to achieve a similar or a lower resistance in comparison to electrical traces between fluidic ports arranged in a non-staggered configuration.

Such a configuration allows for a more reliable coverage of a passivation material to be provided on the electrical traces 32, thereby reducing the likelihood of failure thereof and, as such, improving the reliability of the inkjet printhead. Furthermore, reducing the thickness of the passivation material allows for a reduction of the topography of the surface of the substrate on which the electrical traces and passivation material are deposited.

Additionally or alternatively, the increased width between adjacent fluidic ports 13*a*/13*b* provides for increased space for providing greater numbers of electrical traces therebetween.

For example, as shown in FIG. 2*c*, multiple electrical traces 32*a*/32*b* may be routed through adjacent fluidic ports 13*a*/13*b*. In some embodiments the electrical traces 32*a*/32*b* may be arranged on the same horizontal plane parallel to the top surface of the fluidic chamber substrate or may be arranged along a different horizontal plane. As above, the electrical traces 32*a*/32*b* may be separated by a passivation material 33, and may comprise further electrical traces (not shown) stacked atop thereof.

A suitable stagger offset distance (O) may, for example, be between fpm and 1000 μm depending on, for example, the NPI required and/or the limitation imposed by the materials and/or available space, e.g. the fluidic chamber substrate may be a fixed size.

Whilst the fluidic ports 13*a-d*/16*a-d* of FIGS. 2*a* and 2*b* are substantially depicted as square shaped, the fluidic ports may be any suitable shape.

For example, the fluidic ports may be substantially: rectangular, circular, oval, triangular, rhombic, pentagonal or hexagonal in shape.

Figure 3A:
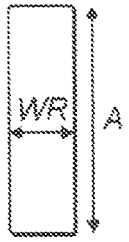
FIG. 3*a*(*i*) is a schematic diagram showing a rectangular shaped fluidic port according to an embodiment.

FIG. 3*a*(*i*)-3*a*(*iv*) are schematic diagrams showing the fluidic ports 13*a*-13*d*, whereby (A) is the length of the widest region (WR) of a fluidic port, and whereby (A)≥0 μm. It will be seen that for the rectangular and hexagonal shaped fluidic ports (as shown in FIGS. 3*a*(*i*)-3*a*(*iii*) respectively), (A) is greater than 0 μm, whilst for the circular shaped fluidic port of FIG. 3*a*(*iv*), (A) is substantially equal to 0 μm.

Figure 3B:
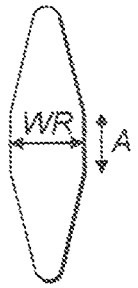
FIG. 3*b* is a schematic diagram showing a plurality of rectangular shaped fluidic ports arranged in a non-staggered configuration.
Figure 3B:
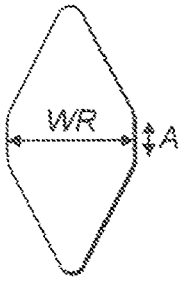
Figure 3B:
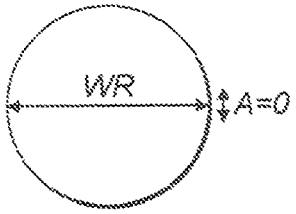
Figure 3B:
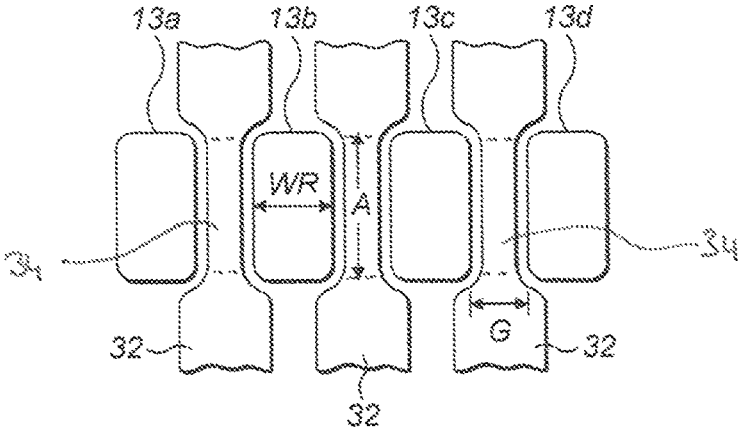

FIG. 3*b* is a schematic diagram showing the distance (G) between adjacent fluidic ports 13*a*-13*d* arranged in a non-staggered configuration. It will be appreciated that in a non-staggered configuration, the stagger offset distance (O) is substantially equal to 0 μm. As will be further appreciated, the width of the reduced portion 34 of the electrical traces 32 provided between adjacent fluidic ports 13*a*-13*d* will be limited by (G), whilst the length of the reduced portion 34 will be limited by (A).

Figure 3C:
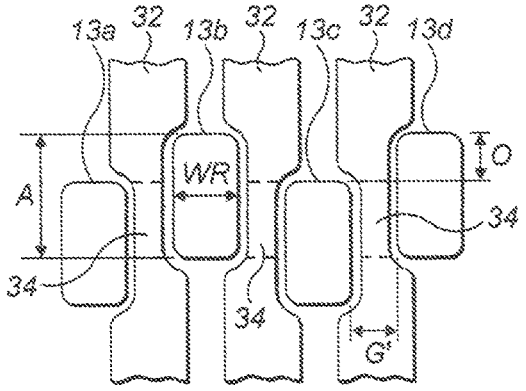
FIG. 3*c* is a schematic diagram showing the plurality of rectangular shaped fluidic ports of FIG. 3*b* arranged in a staggered configuration according to an embodiment.
Figure 3D:
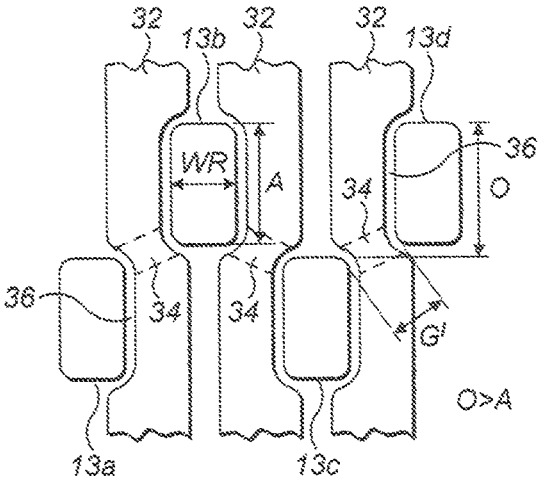
FIG. 3*d* is a schematic diagram showing the plurality of rectangular shaped fluidic ports of FIG. 3*b* arranged in a staggered configuration according to a further embodiment.
Figure 3E:
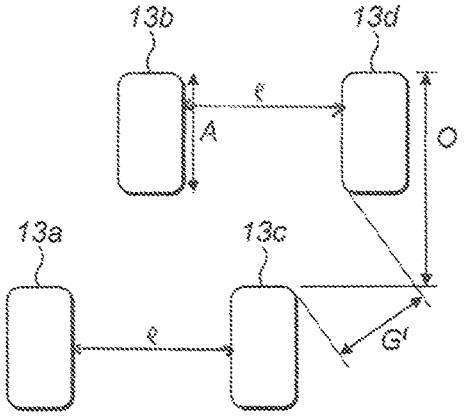
FIG. 3*e* is a schematic diagram showing the plurality of rectangular shaped fluidic ports of FIG. 3*b* arranged in a staggered configuration according to a further embodiment.

FIG. 3*c*-3*e* are schematic diagrams showing the distance (G') between the adjacent fluidic ports 13*a*-13*d* arranged in a staggered configuration, whereby the stagger offset distance (O)>0 μm.

From FIG. 3*c* it will be appreciated that when the stagger offset distance (O) is less than or equal to the length of the widest region (WR) of the fluidic ports 13*a*-13*d*, the distance (G') is substantially equal to (G) (i.e. (G')≈(G) when (O)≤(A)). However, it will be appreciated that such a configuration (i.e. 0 μm≤(O)≤A) allows for an electrical trace 32 having a reduced portion 34 with a shorter length to be provided between the staggered fluidic ports 13*a*-13*d* of the staggered configuration in comparison to an electrical trace provided between fluidic ports in a non-staggered configuration.

From FIGS. 3*d* and 3*e* it will be appreciated that when the stagger offset distance (O) is greater than the length (A) of the widest region (WR) of the fluidic ports, the distance (G') is greater than the distance (G) (i.e. (G')>(G) when (O)>(A))), whereby it will be appreciated that (G') is proportional to (O), such that as (O) increases, (G') also increases. Therefore, it will also be appreciated that it is possible to increase the width of electrical traces 32 provided between adjacent fluidic ports 13*a*-13*d* as (O) is increased, thereby reducing the resistance of the electrical traces 32 and, as a result, the likelihood of failure (e.g. due to burnout) of the electrical traces is decreased, thereby increasing the reliability of the inkjet printhead. Additionally or alternatively, a larger separation gap 36 may be provided between the fluidic ports 13*a*-13*d* and the electrical traces 32, thereby reducing the likelihood of ink contacting the electrical traces 32 during operation of the inkjet printhead.

Furthermore, it will be appreciated that as (O) increases, the distance (G') may be increased such that it is greater than the distance (P) between two fluidic ports which are not staggered with respect to each other.

Figure 4A:
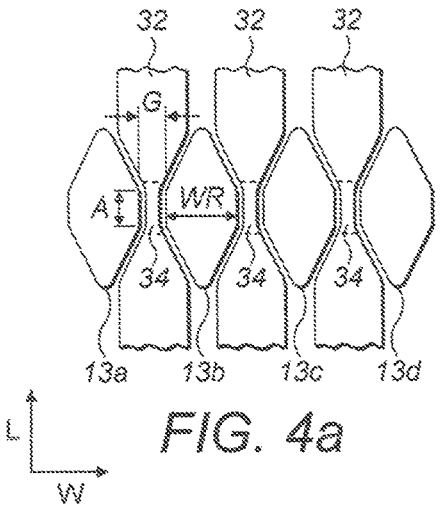
FIG. 4*a* is a schematic diagram showing hexagonal shaped fluidic ports arranged in a non-staggered configuration.
Figure 4B:
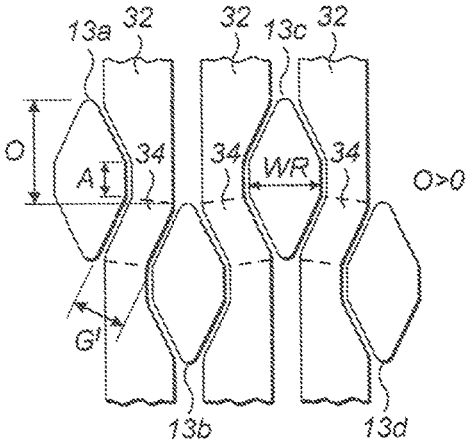
FIG. 4*b* is a schematic diagram showing the hexagonal shaped fluidic ports of FIG. 4*a* arranged in a staggered configuration according to a further embodiment.
Figure 4C:
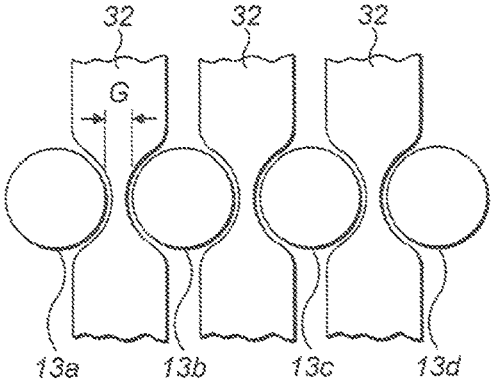
FIG. 4*c* is a schematic diagram showing circular shaped fluidic ports arranged in a non-staggered configuration.

FIG. 4*a* is a schematic diagram of substantially hexagonal shaped fluidic ports 13*a*-13*d* arranged in a non-staggered configuration whilst FIG. 4*b* is a schematic diagram of the substantially hexagonal shaped fluidic ports 13*a*-13*d* of FIG. 4*a* arranged in a staggered configuration according to a further embodiment. FIG. 4*c* is a schematic diagram of substantially circular shaped fluidic ports 13*a*-13*d* arranged in a non-staggered configuration; whilst FIG. 4*d* is a schematic diagram of the substantially circular shaped fluidic ports 13*a*-13*d* arranged in a staggered configuration according to a further embodiment.

As depicted in FIGS. 4*a* and 4*c*, the respective fluidic ports 13*a*-13*d* are arranged in a non-staggered configuration, whereby a stagger offset distance (O) is substantially equal to (0) zero μm (i.e. (O)≈0 μm), and adjacent fluidic ports 13*a* & 13*b*, 13*b* & 13*c*, and 13*c* & 13*d* are separated by a distance (G) between the closest points thereof.

Figure 4D:
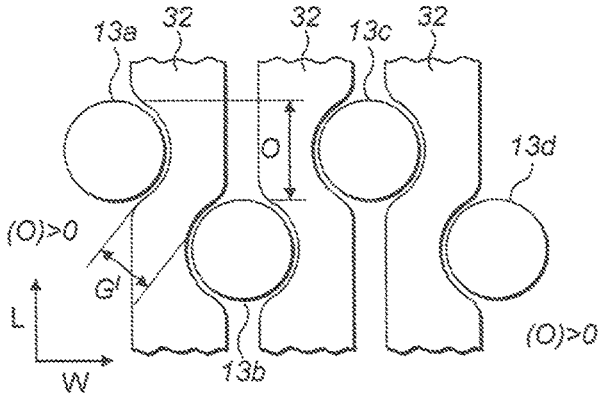
FIG. 4*d* is a schematic diagram showing the circular shaped fluidic ports of FIG. 4*c* arranged in a staggered configuration according to a further embodiment.

In FIGS. 4*b* and 4*d*, adjacent fluidic ports 13*a*-13*d* are staggered with respect to each other by a stagger offset distance (O) whereby (O)>0 μm.

As described above, when (O)>(A), the distance (G') between closest points of adjacent fluidic ports 13*a*-13*d* arranged in a staggered configuration with respect to each other is greater than the distance (G) between closest points of adjacent fluidic ports in the non-staggered configuration (i.e. (G')>(G) when (O)>(A)).

It will further be appreciated that when using substantially hexagonal shaped fluidic ports (see, for example, FIGS. 3*a*(*ii*), 3*a*(*iii*), 4*a* and 4*b*), a smaller stagger offset distance (O) is required to provide a substantially similar increase in the distance (G') between adjacent fluidic ports in comparison to substantially square fluidic ports having a substantially equal cross sectional area (see, for example, FIGS. 2*a* and 2*b*) or substantially rectangular fluidic ports having a substantially equal cross sectional area (see, for example, FIGS. 3*a*(*i*) and 3*b*-3*e*).

Therefore, it will be appreciated that substantially hexagonal shaped fluidic ports provide for improved spatial efficiency in comparison to square or rectangular shaped fluidic ports.

Similarly, when using substantially circular shaped fluidic ports (see, for example, FIGS. 4*c* and 4*d*), a smaller stagger offset distance (O) is required to provide a substantially similar increase in distance (G') between adjacent fluidic ports in comparison to substantially hexagonal fluidic ports having a substantially equal cross sectional area.

In general, it will be appreciated by a person skilled in the art having read this specification, that such functionality is a consequence of (G') increasing as a result of (O) increasing when (O)>(A).

As such, it will be appreciated that it is possible to increase the width of electrical traces 32 provided between adjacent fluidic ports 13*a*-13*d* as (O) increases when (O)>(A), thereby reducing the resistance of the electrical traces 32. As such, the likelihood of failure (e.g. due to burnout) of the electrical traces decreases, thereby increasing the reliability of the inkjet printhead. Additionally or alternatively, a larger separation gap may be provided between the fluidic ports and the electrical traces, thereby reducing the likelihood of ink contacting the electrical traces during operation of the printhead. Additionally or alternatively, the thickness of the electrical traces and/or the passivation material provided atop such electrical traces may be reduced.

Whilst the fluidic ports 13*a-d*/16*a-d* of FIGS. 2*a*-4*d* are depicted as having reflection symmetry, fluidic ports having reflection asymmetry may also be provided in a staggered configuration.

Figure 5A:
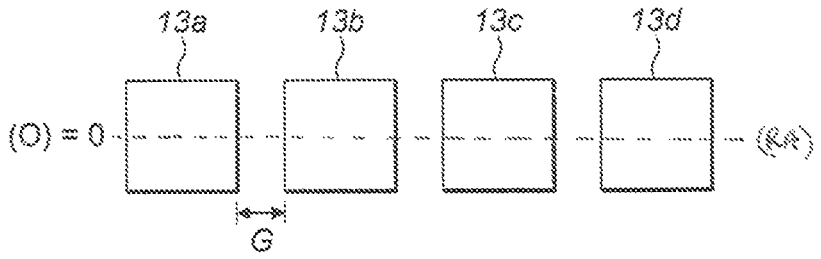
FIG. 5*a* is a schematic diagram showing fluidic ports having reflection symmetry arranged in a non-staggered configuration.

FIG. 5*a* is a schematic diagram showing fluidic ports 13*a*-13*d* of droplet units (not shown) having reflection symmetry about a reflection axis (RA), whereby the fluidic ports 13*a*-13*d* are arranged in a non-staggered configuration with respect to each other.

A distance (G) is provided between closest points of adjacent fluidic ports 13*a*-13*d* arranged in a non-staggered configuration as previously described. It will also be appreciated that the substantially square, rectangular, hexagonal and circular shaped fluidic ports as previously described comprise reflection symmetry about the reflection axis (RA).

Figure 5B:
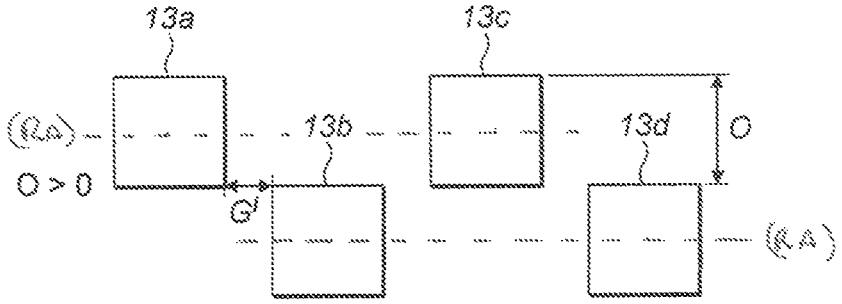
FIG. 5*b* is a schematic diagram showing the fluidic ports of FIG. 5*a* arranged in a staggered configuration according to an embodiment.

FIG. 5*b* is a schematic diagram showing the fluidic ports 13*a*-13*d* having reflection symmetry about reflection axis (RA) and arranged in a staggered configuration with respect to each other.

A stagger offset distance (O)>0 for the fluidic ports 13*a*-13*d* provides a distance (G') between adjacent fluidic ports arranged in a staggered configuration as previously described.

Figure 5C:
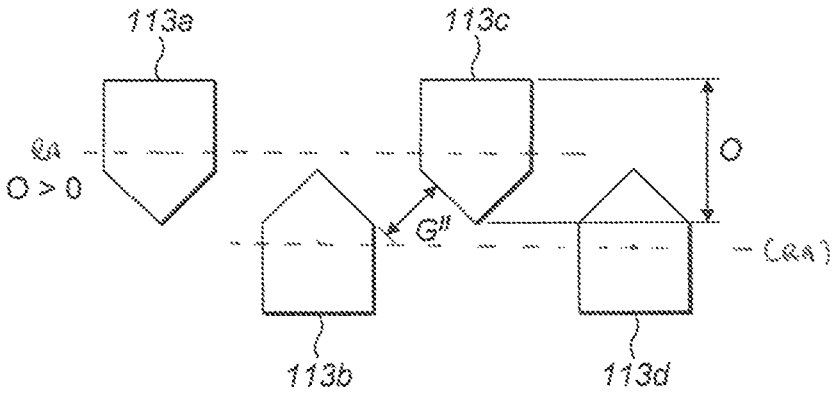
FIG. 5*c* is a schematic diagram showing fluidic ports having reflection asymmetry arranged in a staggered configuration according to a further embodiment.

FIG. 5*c* is a schematic diagram showing fluidic ports 113*a*-113*d* of droplet units (not shown) having reflection asymmetry about a reflection axis (RA), whereby the fluidic ports 113*a*-113*d* are arranged in a staggered configuration with respect to each other. A stagger offset distance (O)>0 provides a distance (G") between the adjacent fluidic ports 113*a*-113*d* having reflection asymmetry and arranged in a staggered configuration with respect to each other.

It will be appreciated that fluidic ports 113*a*-113*d* having reflection asymmetry and arranged in a staggered configuration offset by (O), and having a substantially similar cross sectional area as the fluidic ports 13*a*-13*d* shown in FIGS. 5*a* and 5*b* may provide for an increased distance (G") between the closest points of adjacent fluidic ports 113*a*-113*d* in comparison to the fluidic ports 13*a*-13*d*. Therefore, for a particular offset distance (O), (G")>(G').

Therefore, it will be appreciated that fluidic ports having reflection asymmetry arranged in a staggered configuration with respect to each other provide for improved spatial efficiency within a printhead substrate in comparison to fluidic ports having reflection symmetry arranged in a staggered or non-staggered configuration, and having a substantially similar cross section area.

As such, it will be appreciated that when (G")>(G') it is possible to increase the width of electrical traces provided between adjacent fluidic ports, thereby reducing the resistance of the electrical traces. As such, the likelihood of failure (e.g. due to burnout) of the electrical traces decreases, thereby increasing the reliability of the inkjet printhead.

Additionally or alternatively, a larger separation gap may be provided between the fluidic ports and the electrical traces, thereby reducing the likelihood of ink contacting the electrical traces during operation of the printhead. Additionally or alternatively, the thickness of a passivation material provided atop such electrical traces may be reduced.

Figure 6A:
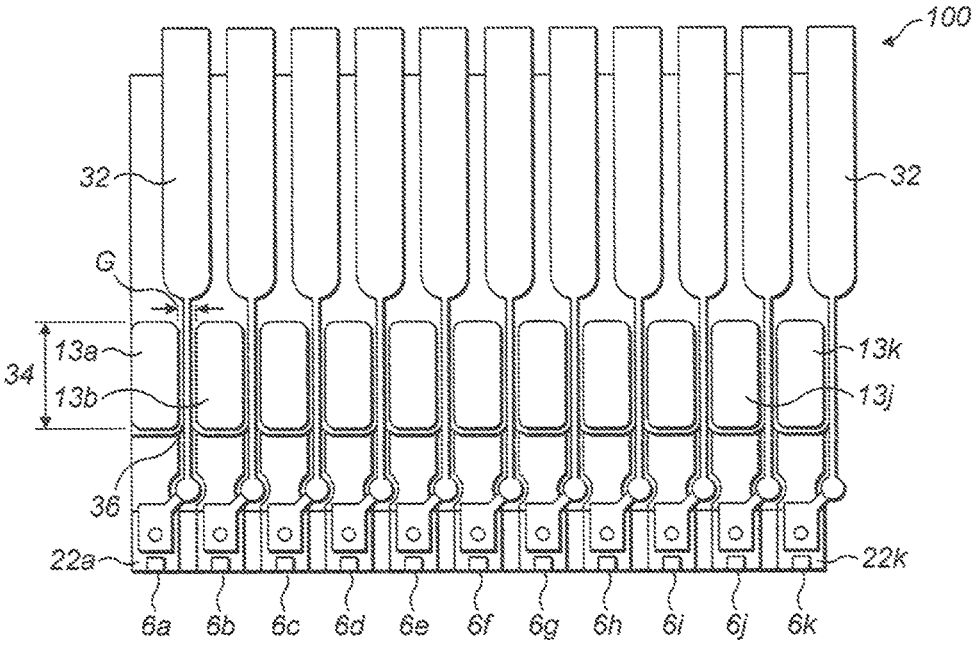
FIG. 6*a* is a schematic diagram showing a top down view of an inkjet printhead having an array of droplet generating units having corresponding fluidic ports arranged in a non-staggered configuration.

FIG. 6*a* is a schematic diagram showing a top down view of an inkjet printhead 100 having an array of droplet units 6*a*-6*k*, having substantially rectangular shaped fluidic ports 13*a*-13*k*, arranged in a non-staggered configuration according to an illustrative example. A wiring layer, e.g. comprising electrical traces 32 as described previously, is provided to supply signals (e.g. drive signals) from a drive circuit (not shown) to piezoelectric actuators 22*a*-22*k*.

In the printhead 100, the distance (G) between adjacent fluidic ports 13*a*/13*b* is substantially equal to 20 μm. The width of the electrical traces 32 at the narrow portion 34 passing between the adjacent fluidic ports 13*a*-13*k* is substantially equal to 10 μm, whereby separation gaps 36 of approximately 5 μm are provided between the electrical traces 32 and the corresponding fluidic ports 13*a*-13*k*. The thickness of the electrical traces 32 may, for example, be between 0.1 μm and 2 μm.

Figure 6B:
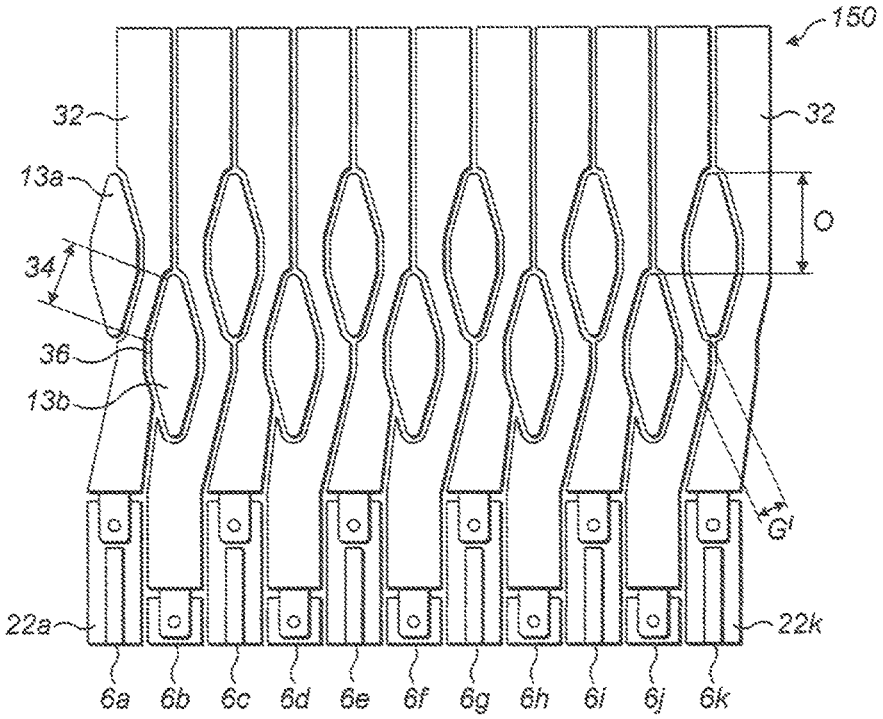
FIG. 6*b* is a schematic diagram showing a top down view of an inkjet printhead having an array of droplet generating units having fluidic ports arranged in a staggered configuration according to an embodiment.

FIG. 6*b* is a schematic diagram showing a top down view of an inkjet printhead 150 having an array of droplet units 6*a*-6*k* according to an embodiment. In the present embodiment, the droplet units 6*a*-6*k* comprise substantially hexagonal shaped fluidic ports 13*a*-13*k*, arranged in a staggered configuration according to an embodiment.

In the present embodiment, adjacent droplet units 6*a*-6*k* are offset from each other by a stagger offset distance (O) in the length-wise direction of the droplet units 6, whereby the stagger offset distance (O), may, for example, be substantially equal to 100 μm. It will however be appreciated that any suitable stagger offset distance (O) may be used.

In the printhead 150, the distance (G') between adjacent fluidic ports 13*a*/13*b* is substantially equal to 30 μm. The width of the electrical traces 32 at the narrow portion 34 passing between the adjacent fluidic ports 13*a*/13*b* is substantially equal to 20 μm, whereby separation gaps 36 of approximately 5 μm are provided between the electrical trace 32 and the corresponding fluidic ports 13*a*/13*b*. As above, the thickness of the electrical traces 32 may be between 0.1 μm and 2 μm.

Therefore, it will be appreciated that by replacing the substantially rectangular shaped fluidic ports (as shown in FIG. 3*a*(*i*)) with the substantially hexagonal shaped fluidic ports (as shown in FIG. 3*a*(*ii*)) and staggering adjacent fluidic ports with respect to each other by a stagger offset distance (O), the distance between the closest points of adjacent fluidic ports in the staggered configuration is greater than then distance between the closest points of adjacent fluidic ports in the non-staggered configuration (i.e. G<G' for (O)). Therefore, wider electrical traces may be provided between adjacent fluidic ports in the staggered configuration in comparison to the non-staggered configuration, whilst maintaining substantially the same, or providing an increased, number of droplet units within a substrate having a fixed area, such that the resolution of the inkjet printhead is maintained substantially similar or increased.

Furthermore, it will be appreciated that whilst adjacent fluidic ports 13*a*/13*b* may be staggered with respect to each other, fluidic ports which are not directly adjacent each other may be arranged in a non-staggered configuration with respect to each other (as shown in FIGS. 2*a*, 3*c*-3*e*, 4*b*, 4*d*, 5*b*, 5*c* and 6*b*), or such fluidic ports may also be arranged in a staggered configuration with respect to each other as required depending on the application.

Furthermore, whilst the present invention has been described in relation to printheads fabricated using thin film techniques, it will be appreciated that the invention could also be applied to printheads fabricated using different techniques e.g. bulk-machining techniques.

It will also be appreciated that the inkjet printheads described in the embodiments above could be incorporated into an inkjet printer, whereby the inkjet printer may comprise hardware and software components required to drive the inkjet printheads. For example, the inkjet printer may comprise ink reservoirs, ink pumps and valves for managing the ink supply to/from the fluidic chambers, whilst the inkjet printer may further comprise electronic circuitry and software (e.g. programs, waveforms) for supplying signals to individual actuators of the inkjet printhead to generate and control droplets as required.

Furthermore, it will be appreciated that any signal used to control the ejection of ink from the droplet units onto print media should take account of, for example, the stagger offset distances provided between adjacent droplet generator units in the inkjet printhead and should be synchronized with, for example, the jetting pulse width and the media speed.

It will also be appreciated that the present invention is not limited to the above described embodiments, and various modifications and improvements may be made within the scope of the present invention.

The invention claimed is:

1. An inkjet printhead, comprising:

a fluidic chamber substrate comprising a plurality of droplet units provided adjacent one another in an array, the array extending in an array direction, each of the droplet units comprising:

a fluidic chamber;

a first fluidic port provided at a first surface of the fluidic chamber substrate, wherein the first fluidic port is in fluidic communication with the fluidic chamber;

a nozzle formed in a nozzle layer provided at a second surface of the fluidic chamber substrate and in fluidic communication with the fluidic chamber; and a vibration plate provided at the first surface of the fluidic chamber substrate, the vibration plate comprising an actuator for effecting pressure fluctuations within the fluidic chamber, wherein:

corresponding first fluidic ports of the droplet units are:

arranged along the array direction, and staggered in a direction perpendicular to the array direction at a first stagger offset distance from each other, and a wiring layer extends over the first surface of the fluidic chamber substrate and between the first fluidic ports.

2. The inkjet printhead according to claim 1, wherein:

corresponding fluidic chambers, nozzles and actuators of the droplet units are staggered at the first stagger offset distance in a direction perpendicular to the array direction.

3. The inkjet printhead according to claim 1, wherein:

each of the droplet units further comprises a second fluidic port provided at the first surface of the fluidic chamber substrate, and corresponding second fluidic ports of the droplet units are in fluidic communication with the corresponding fluidic chambers.

4. The inkjet printhead according to claim 3 wherein:

the corresponding second fluidic ports are staggered at a second stagger offset distance from each other in a direction perpendicular to the array direction; and the wiring layer further extends between the second fluidic ports.

5. The inkjet printhead according to claim 4, wherein a separation gap is provided between a sidewall of the wiring layer and the corresponding first fluidic ports.

6. The inkjet printhead according to claim 3, wherein:

the corresponding second fluidic ports are staggered at a second stagger offset distance from each other in a direction perpendicular to the array direction; and the first stagger offset distance is equal to the second stagger offset distance.

7. The inkjet printhead according to claim 3, wherein the corresponding second fluidic ports are staggered at a second stagger offset distance from each other in a direction perpendicular to the array direction.

8. The inkjet printhead according to claim 3, wherein:

the corresponding second fluidic ports, and corresponding fluidic chambers, nozzles and actuators of the droplet units are staggered at the first or second stagger offset distance in a direction perpendicular to the array direction.

9. The inkjet printhead according to claim 1, wherein:

the wiring layer comprises a reduced portion between the first fluidic ports; and the width of the wiring layer is limited by a distance between the corresponding first fluidic ports.

10. The inkjet printhead according to claim 1, wherein:

a distance between adjacent corresponding first fluidic ports is less than half the first stagger offset distance;

the wiring layer comprises a narrow portion between adjacent corresponding first fluidic ports, a width of the narrow portion being smaller than the distance between adjacent corresponding first fluidic ports; and a thickness of the wiring layer is one tenth or less the width of the narrow portion.

11. A fluidic chamber substrate, comprising:

a plurality of droplet units provided adjacent one another in an array, the array extending in an array direction, each of the droplet units comprising:

a fluidic chamber, a first fluidic port provided at a first surface of the fluidic chamber substrate, wherein the first fluidic port is in fluidic communication with the fluidic chamber;

a nozzle formed in a nozzle layer provided at a second surface of the fluidic chamber substrate and in fluidic communication with the fluidic chamber; and a vibration plate provided at the first surface of the fluidic chamber substrate, the vibration plate comprising an actuator for effecting pressure fluctuations within the fluidic chamber; and wherein:

corresponding first fluidic ports of the droplet units are:

arranged along the array direction, and staggered in a direction perpendicular to the array direction at a first stagger offset distance from each other, and a wiring layer extends over the first surface of the fluidic chamber substrate and between the first fluidic ports.

12. The fluidic chamber substrate according to claim 11, wherein corresponding fluidic chambers, nozzles, and actuators of the droplet units are staggered at the first stagger offset distance in a direction perpendicular to the array direction.

13. The fluidic chamber substrate according to claim 11, wherein:

each of the droplet units further comprise a second fluidic port provided at the first surface of the fluidic chamber substrate, and corresponding second fluidic ports of the droplet units are in fluidic communication with corresponding fluidic chambers of the droplet units.

14. The fluidic chamber substrate according to claim 13, wherein:

the corresponding second fluidic ports are staggered at a second stagger offset distance from each other in a direction perpendicular to the array direction; and the wiring layer further extends between the second fluidic ports.

15. The fluidic chamber substrate according to claim 14, wherein a separation gap is provided between a sidewall of the wiring layer and the corresponding first fluidic ports.

16. The fluidic chamber substrate according to claim 13, wherein:

the corresponding second fluidic ports are staggered at a second stagger offset distance from each other in a direction perpendicular to the array direction; and the first stagger offset distance is equal to the second stagger offset distance.

17. The fluidic chamber substrate according to claim 13, wherein the corresponding second fluidic ports are staggered at a second stagger offset distance from each other in a direction perpendicular to the array direction.

18. The fluidic chamber substrate according to claim 13, wherein:

the corresponding second fluidic ports, and corresponding fluidic chambers, nozzles and actuators of the droplet units are staggered at the first or second stagger offset distance in a direction perpendicular to the array direction.

19. An inkjet printer comprising:

an inkjet printhead comprising:

a fluidic chamber substrate comprising a plurality of droplet units provided adjacent one another in an array therein, the array extending in an array direction, each of the droplet units comprising:

a fluidic chamber;

a first fluidic port provided at a first surface of the fluidic chamber substrate, wherein the first fluidic port is in fluidic communication with the fluidic chamber;

a nozzle formed in a nozzle layer provided at a second surface of the fluidic chamber substrate and in fluidic communication with the fluidic chamber; and a vibration plate provided at the first surface of the fluidic chamber substrate, the vibration plate comprising an actuator for effecting pressure fluctuations within the fluidic chamber;

wherein:

corresponding first fluidic ports of the droplet units are:

arranged along the array direction, and staggered in a direction perpendicular to the array direction at a first stagger offset distance from each other, and a wiring layer extends over the first surface of the fluidic chamber substrate and between the first fluidic ports.

20. The inkjet printer according to claim 19, wherein:

each of the droplet units further comprises a second fluidic port provided at the first surface of the fluidic chamber substrate;

corresponding second fluidic ports of the droplet units are in fluidic communication with corresponding fluidic chambers of the droplet units; and corresponding second fluidic ports, fluidic chambers, nozzles and actuators of the droplet units are staggered at the first stagger offset distance in a direction perpendicular to the array direction.

* * * * *